US010322903B2

(12) United States Patent
Yokomizo

(10) Patent No.: US 10,322,903 B2
(45) Date of Patent: Jun. 18, 2019

(54) PRINTING CONTROL APPARATUS, BINDING CONTROL APPARATUS, METHOD FOR CONTROLLING PRINTING CONTROL APPARATUS, AND PROGRAM THEREFOR

(71) Applicant: CANON KABUSHIKI KAISHA, Tokyo (JP)

(72) Inventor: So Yokomizo, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 199 days.

(21) Appl. No.: 15/601,770

(22) Filed: May 22, 2017

(65) Prior Publication Data

US 2017/0253456 A1 Sep. 7, 2017

Related U.S. Application Data

(63) Continuation of application No. 13/744,271, filed on Jan. 17, 2013, now abandoned.

(30) Foreign Application Priority Data

Feb. 22, 2012 (JP) ..... 2012-035978

(51) Int. Cl.

| | |
|---|---|
| ***G03G 15/00*** | (2006.01) |
| ***B65H 39/00*** | (2006.01) |
| ***B41F 17/00*** | (2006.01) |
| ***B42B 4/00*** | (2006.01) |
| ***B42B 5/10*** | (2006.01) |
| ***B42C 1/12*** | (2006.01) |
| ***B65H 39/10*** | (2006.01) |

(Continued)

(52) U.S. Cl.

CPC ..... *B65H 39/00* (2013.01); *B41F 17/00* (2013.01); *B42B 4/00* (2013.01); *B42B 5/00* (2013.01); *B42B 5/10* (2013.01); *B42C 1/12* (2013.01); *B65H 37/04* (2013.01); *B65H 39/10* (2013.01); *G03G 15/6544* (2013.01); *B65H 2301/133* (2013.01); *B65H 2301/4213* (2013.01); *B65H 2301/43828* (2013.01); *B65H 2301/51616* (2013.01); *B65H 2408/122* (2013.01); *B65H 2511/25* (2013.01); *B65H 2511/30* (2013.01); *B65H 2701/1322* (2013.01); *B65H 2701/13212* (2013.01); *G03G 2215/00848* (2013.01)

(58) Field of Classification Search

CPC ..... G03G 2215/00282; G03G 15/6544; B65H 2301/43828; B65H 2301/51616; B65H 2408/40

See application file for complete search history.

(56) References Cited

U.S. PATENT DOCUMENTS 7,413,177 B2 * 8/2008 Mori ..... B65H 39/11 270/58.04
2006/0067724 A1 * 3/2006 Sato ..... G03G 15/6541 399/82

(Continued)

*Primary Examiner* — Jennifer E Simmons
(74) *Attorney, Agent, or Firm* — Canon U.S.A., Inc. IP Division

(57) ABSTRACT

A printing control apparatus configured to control a binding unit configured to perform a binding processing for binding sheets without using a staple includes a control unit that controls the biding unit to divide sheets subjected to printing into sheet groups in units of a number of sheets bindable by the binding unit, and to apply the binding processing to each of sheet groups or controls another binding unit to bind the sheets subjected to printing using a staple.

10 Claims, 11 Drawing Sheets

(51) Int. Cl.
*B65H 37/04* (2006.01)
*B42B 5/00* (2006.01)

(56) References Cited

U.S. PATENT DOCUMENTS

2008/0172302 A1* 7/2008 Knodt ..... B42C 19/00
705/26.5
2011/0135366 A1* 6/2011 Asai ..... B42C 19/02
399/408

* cited by examiner

PRINTING CONTROL APPARATUS, BINDING CONTROL APPARATUS, METHOD FOR CONTROLLING PRINTING CONTROL APPARATUS, AND PROGRAM THEREFOR

CROSS-REFERENCE TO RELATED APPLICATIONS

This application is a continuation, and claims the benefit, of U.S. patent application Ser. No. 13/744,271 filed Jan. 17, 2013, which claims the benefit of Japanese Patent Application No. 2012-035978 filed Feb. 22, 2012. Each of U.S. patent application Ser. No. 13/744,271 and Japanese Patent Application No. 2012-035978 is hereby incorporated by reference herein in its entirety.

BACKGROUND OF THE INVENTION

Field of the Invention

Aspects of the present invention generally relate to a printing control apparatus capable of controlling binding processing for binding a plurality of sheets, a binding control apparatus, a method for controlling the printing control apparatus, and a program therefor.

Description of the Related Art

Some image processing apparatuses with copy and printer functions are provided with a sheet processing apparatus for performing post-print processing for output printing sheets. One typical function provided by the sheet processing apparatus is a staple binding function. The staple binding function is a function of binding sheets using a metal staple.

Since a staple-bound print product is easy to handle on a volume basis, staple binding is widely used when handling an output product having a plurality of pages.

Recently, however, in consideration of the environment, some binding methods have been devised that do not use a metal staple (hereinafter referred to as stapleless binding methods). For example, a certain stapleless binding method collectively cuts out a part of a set of printed sheets subjected to binding so as to bore the sheets, and folds and binds the tips of the cut portions (refer to Japanese Patent Application Laid-Open No. 8-300847).

As described above, various types of stapleless binding methods have been put in practical use. These methods have different characteristics from binding methods using a metal staple (hereinafter, referred to as staple binding methods). For example, a stapleless binding method provides a less binding force and is, therefore, capable of binding less number of sheets at one time than a staple binding method. When a sheet processing unit capable of performing both staple binding and stapleless binding is connected, the two binding methods differ from each other in binding position, the number of sheets subjected to binding, and concept of front and back sides. Therefore, image position control suitable for each method is required at the time of image generation.

Accordingly, there has been a case where, when the number of sheets subjected to stapleless binding processing exceeds the number of bindable sheets, if the stapleless binding processing is specified by a user, binding processing cannot be applied to a sheet bundle.

SUMMARY OF THE INVENTION

According to an aspect of the present invention, a printing control apparatus configured to control a binding unit configured to perform a binding processing for binding a plurality of sheets without using a staple includes a printing unit configured to perform printing on a sheet, and a control unit configured to control the binding unit to divide a plurality of sheets subjected to printing by the printing unit into a plurality of sheet groups in units of the number of sheets bindable by the binding unit, and to apply the binding processing to each of the plurality of sheet groups.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
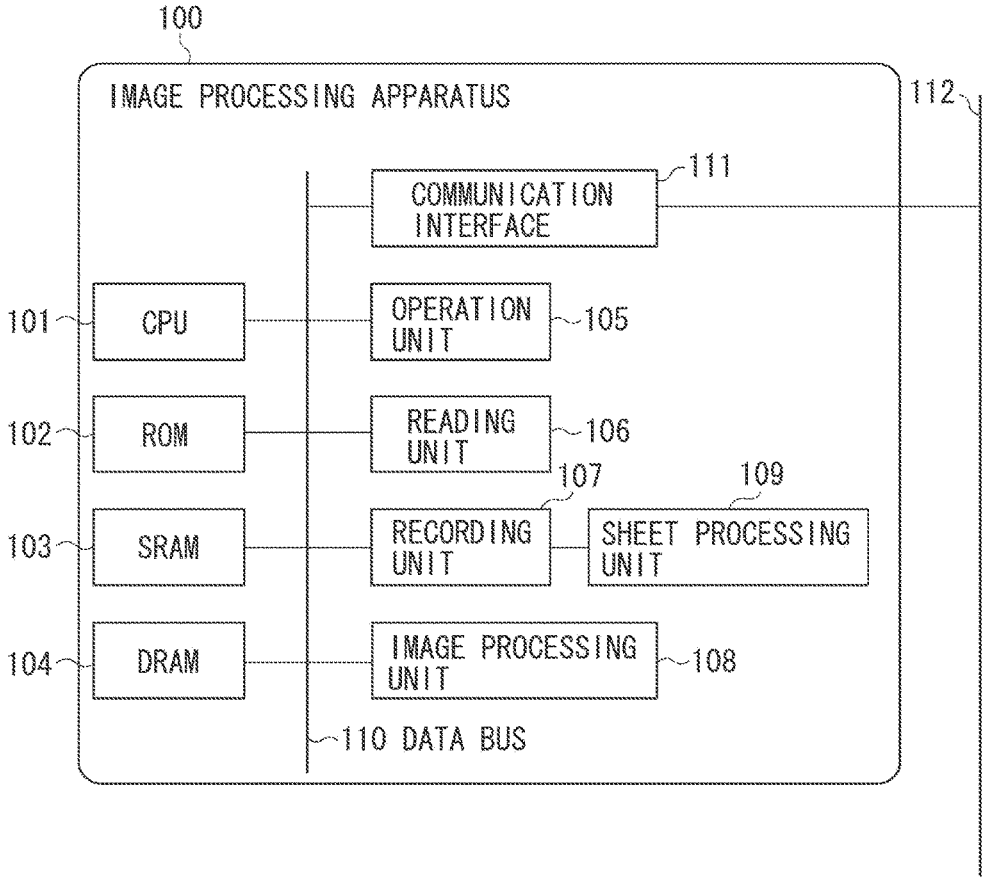
FIG. 1 is a block diagram illustrating a configuration of an image processing apparatus.

A first exemplary embodiment of the present invention will be described below. FIG. 1 is a block diagram illustrating a configuration of an image processing apparatus 100 according to the present exemplary embodiment, where the image processing apparatus 100 is an example of a printing control apparatus. While the following description to the image processing apparatus 100, any apparatus that would function as a printing control apparatus would be applicable. In the present exemplary embodiment, a sheet processing apparatus that performs post-print processing is implemented as part of the image processing apparatus having a function of reading an image and a function of printing an image on a sheet. In another embodiment, the sheet processing apparatus is implemented as an apparatus separate from the image processing apparatus. In each case, the image processing apparatus including the sheet processing apparatus and the sheet processing apparatus as a separate apparatus, function as a binding control apparatus that performs sheet binding processing.

Referring to FIG. 1, a central processing unit (CPU) 101 is a control unit of a system for controlling the entire apparatus. A read-only memory (ROM) 102 stores a control program for the CPU 101. A static random access memory (SRAM) 103 stores setting values registered by an operator, management data of the apparatus, and various working buffers. Since the SRAM 103 is a nonvolatile SRAM backed up by a battery, the contents of the SRAM 103 are retained even after the power of the apparatus is turned OFF. The SRAM 103 also stores read image data.

A dynamic random access memory (DRAM) 104 stores program control parameters. An operation unit 105 is a user interface that displays information inside the apparatus. The operation unit 105 displays a user interface screen (described below). A reading unit 106 reads image data and converts the image data into binary data. The image processing apparatus 100 uses the reading unit 106 to read a document during execution of an image transmission function. A recording unit 107 prints image data on a sheet. An image processing unit 108 performs coding and decoding processing for image data handled by the image transmission function. The above-described function units are connected via a data bus 110 through which image data is transferred.

The recording unit 107 is connected to a sheet processing unit 109. A sheet printed by the recording unit 107 is conveyed to the sheet processing unit 109. The sheet processing unit 109 aligns input sheets, selects an output tray, and performs post-print processing such as binding processing for binding a plurality of sheets. In the present exemplary embodiment, two different processing is used: processing for binding a sheet bundle by using a staple (referred to as first binding processing) and processing for binding a sheet bundle without using a staple (referred to as second binding processing).

With the thus-configured image processing apparatus 100, the reading unit 106 reads a document image to convert the image into binary data, and the SRAM 103 temporarily stores the read image data therein. An example of printing control will be described below, in which the image processing unit 108 converts the image data stored in the SRAM 103, the recording unit 107 prints the image on a sheet, and the sheet processing unit 109 performs post-print processing.

Figure 2:
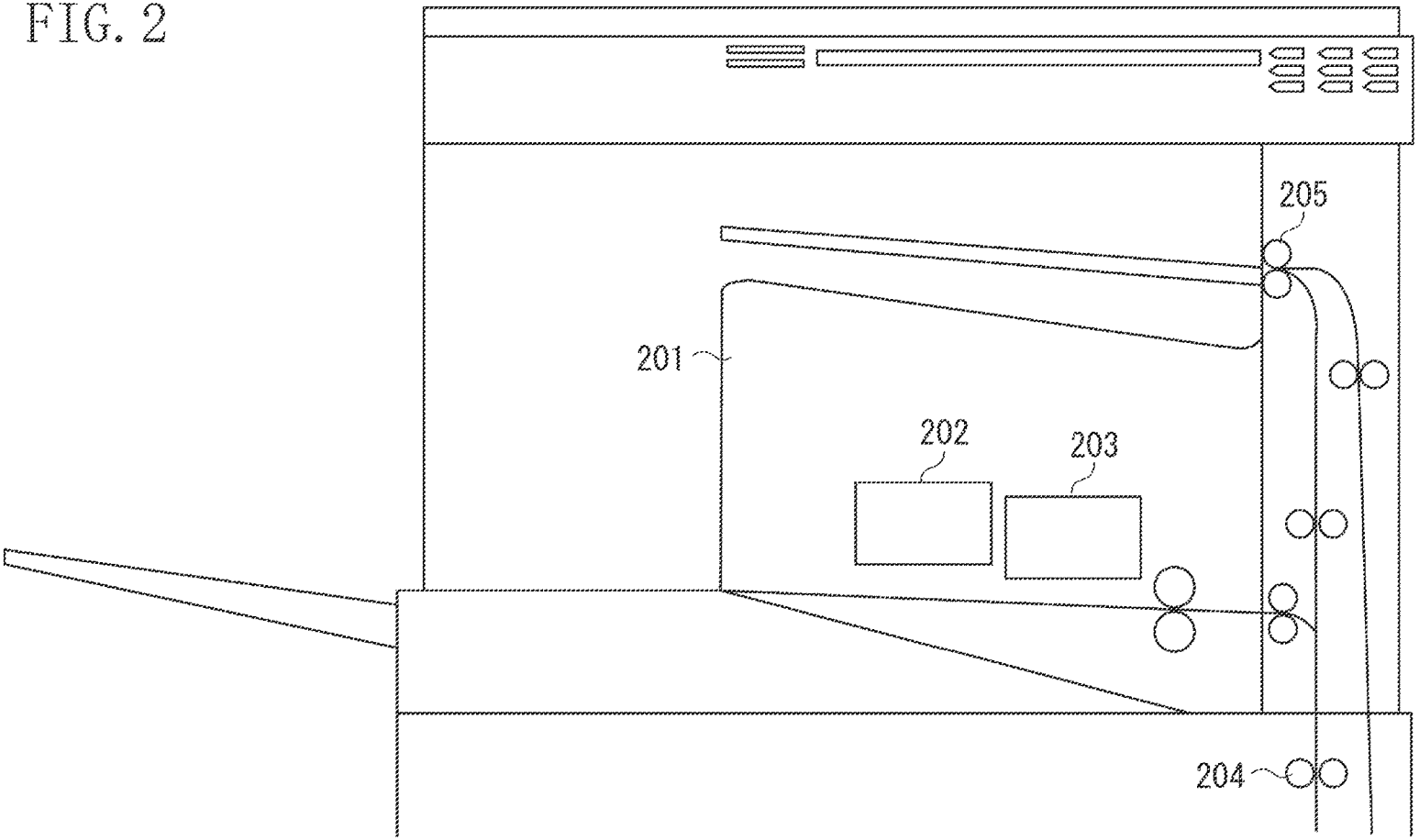
FIG. 2 is a cross sectional view illustrating an example of a configuration of a sheet processing unit.

FIG. 2 is a cross sectional view illustrating in more detail an example of a configuration of the sheet processing unit 109 illustrated in FIG. 1. In the present exemplary embodiment, the sheet processing unit 109 is installed in the chassis of the sheet processing apparatus of the image processing apparatus 100.

Descriptions on the recording unit 107 having an engine for executing print processing will be omitted. The sheet processing unit 109 is used being connected to the main unit of the image processing apparatus 100. Although the connection mode of the sheet processing unit 109 includes the in-line mode and other modes, the application of the present exemplary embodiment is not limited thereto.

Referring to FIG. 2, a sheet processing apparatus 201 is used being connected to the recording unit 107. A sheet is conveyed from the recording unit 107 to the sheet processing apparatus 201 via a conveyance roller pair 204. A conveyance roller pair 205 reverses a sheet at the time of two-sided printing. After being reversed, the sheet enters the recording unit 107 again via the conveyance roller pair 205 to be subjected to printing on the back side of the sheet. Also in this case, an output sheet is sent to the sheet processing apparatus 201 via the conveyance roller pair 204.

Although the sheet processing apparatus 201 is provided with a function of truing up output sheets and a function of moving output sheets, a binding function will be focused.

A first binding unit 202 is a stapler having a staple binding function that uses a metal staple. A second binding unit 203 has a stapleless sheet binding function that does not use a metal staple. Although there are many types of stapleless binding methods as described above, herein, the sheet processing unit 201 is exemplified to be provided with a stapleless binding method for binding sheets by applying pressure thereto from the upside and downside in the thickness direction to make them closely contact.

For example, the sheet processing apparatus 201 includes both the first binding unit 202 and the second binding unit 203. However, the sheet processing apparatus 201 may include only the second binding unit 203, which performs stapleless binding. A case where the sheet processing apparatus 201 is provided with the first binding unit 202 and the second binding unit 203, and a case where the sheet processing apparatus 201 is provided only with the second binding unit 203 will be described below.

When using the stapleless binding function, it is necessary to allocate a larger processing portion on the sheets than with the staple binding function, as described above.

Figure 3:
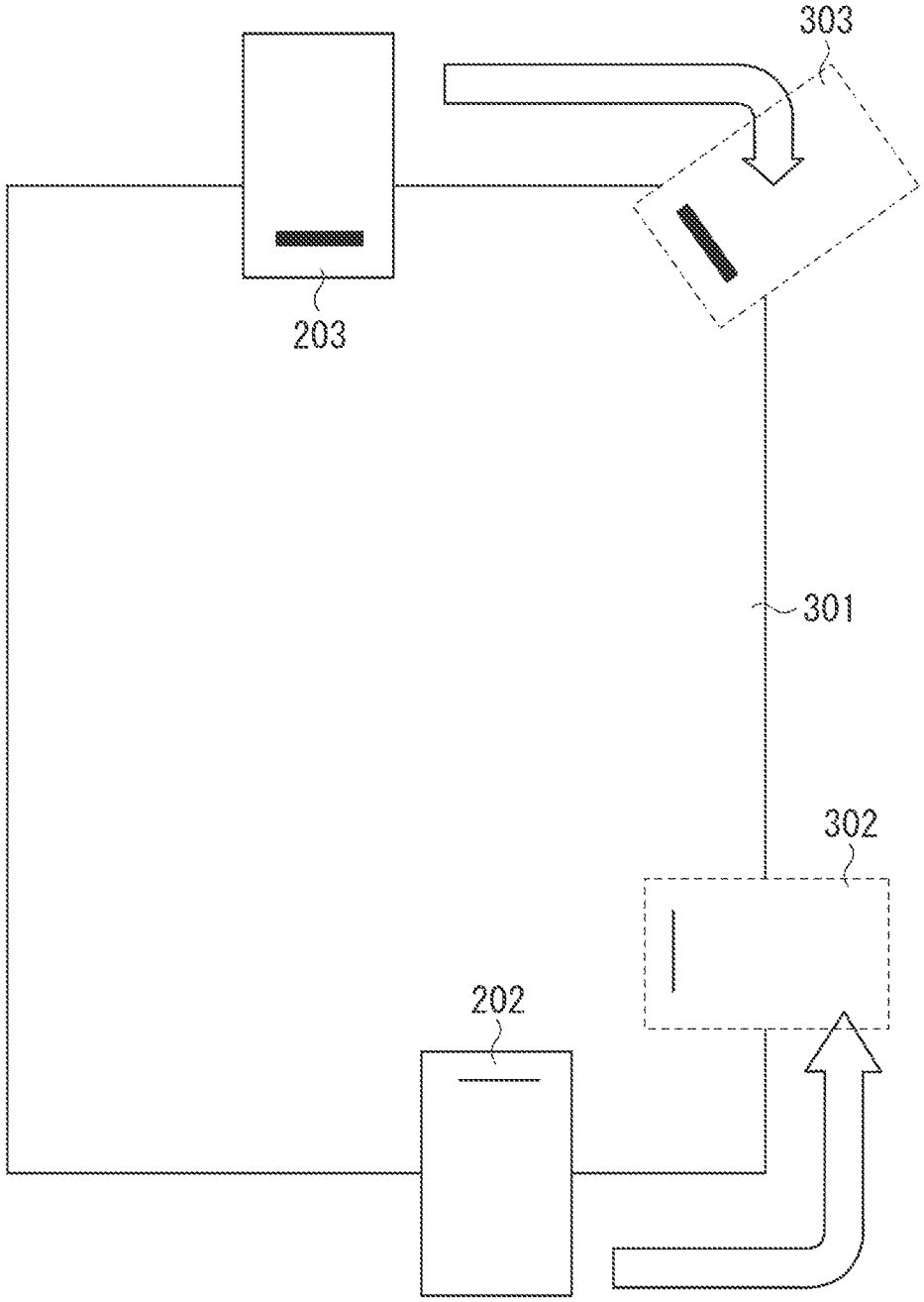
FIG. 3 illustrates arrangements of binding portions and binding work areas.

FIG. 3 illustrates arrangements of the first binding unit 202 and the second binding unit 203 illustrated in FIG. 2, and the binding work areas.

FIG. 3 illustrates a state where sheets 301 are subjected to binding, and the first binding unit 202 is stopped at a standby position. When actually binding the sheets 301, the first binding unit 202 moves from the standby position to a binding position 302 indicated by an arrow and performs sheet binding. Although a mechanism for moving the first binding unit 202 is omitted, its movement is controlled by an instruction from the CPU 101.

Likewise, the second binding unit 203, which performs stapleless binding, is regularly stopped at a standby position, and, when actually binding the sheets, moves from the standby position to a binding position 303 to perform sheet binding. As described above, the first binding unit 202 and the second binding unit 203 are movable under the control of the CPU 101 illustrated in FIG. 1, according to a binding method.

Figure 4A:
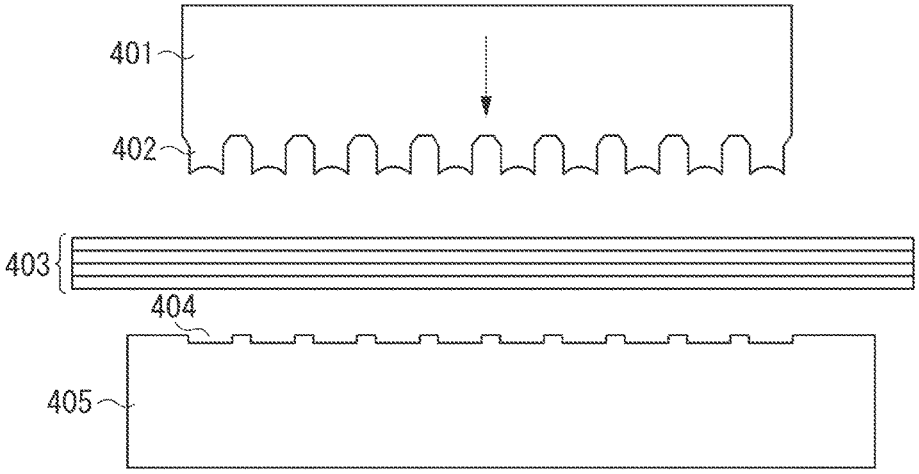
FIGS. 4A and 4B are cross sectional views illustrating binding processing by a second binding unit illustrated in FIG. 2.
Figure 4B:
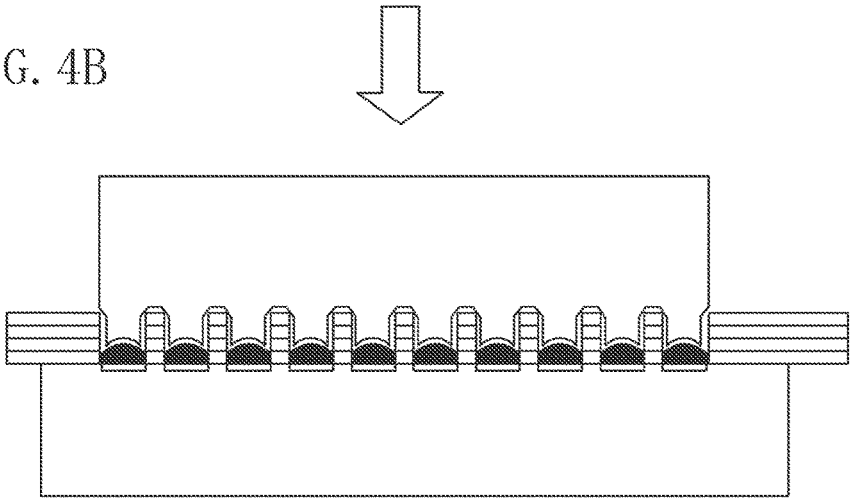

FIGS. 4A and 4B are cross sectional views illustrating binding processing by the second binding unit 203 illustrated in FIG. 2. The method for binding sheets by applying pressure thereto from the upside and downside in the thickness direction to make them closely contact will be described below. Specifically, FIG. 4A illustrates a state where output sheets are set at the binding position, and the second binding unit 203 is moved to the binding position 303, as illustrated in FIG. 3.

Figure 5:
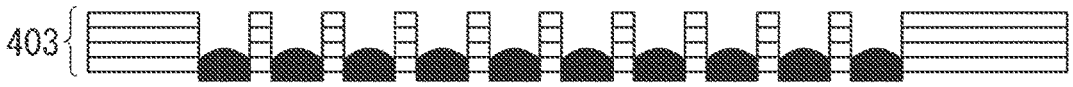
FIG. 5 is a cross sectional view illustrating a sheet to which binding processing by the second binding unit illustrated in FIG. 2 is applied.

Referring to FIGS. 4A and 4B, an upper mold 401 applies pressure onto the sheets from the upside. The upper mold 401 is provided with a plurality of convex blades. The upper mold 401 applies pressure onto the sheets at a plurality of portions to prevent the sheets from easily being separated. A lower mold 405 applies pressure onto the sheets from the downside. The lower mold 405 is provided with a plurality of concave portions 404 corresponding to convex portions 402 of the upper mold 401 to receive the convex blades of the upper mold 401. As illustrated in FIG. 4B, the upper mold 401 and the lower mold 405 apply pressure onto an output sheet bundle 403 from the upside and downside, respectively, by using a pressure mechanism (not illustrated), thus binding the output sheet bundle 403. The cross section of the output sheet bundle 403 after binding is illustrated in FIG. 5. When the sheet bundle 403 is viewed from above, a binding position 601 is illustrated as shown in FIG. 6.

Figure 6:
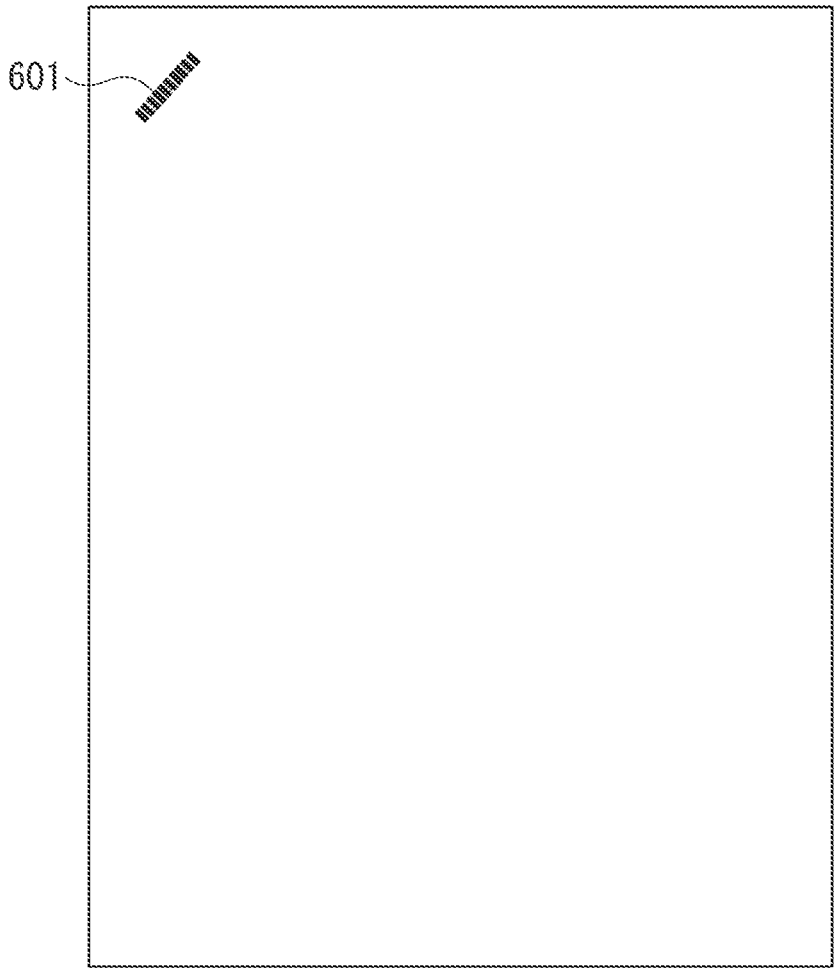
FIG. 6 is a plan view illustrating a sheet to which binding processing by the second binding unit illustrated in FIG. 2 is applied.

In the present exemplary embodiment, black portions at the binding position 601 illustrated in FIG. 6 indicate sheet portions pressed and crushed. Since this method uses pressure, the number of bindable sheets is limited.

Further, the binding processing can be applied twice because applying the binding processing only once provides a weak force.

Figure 7:
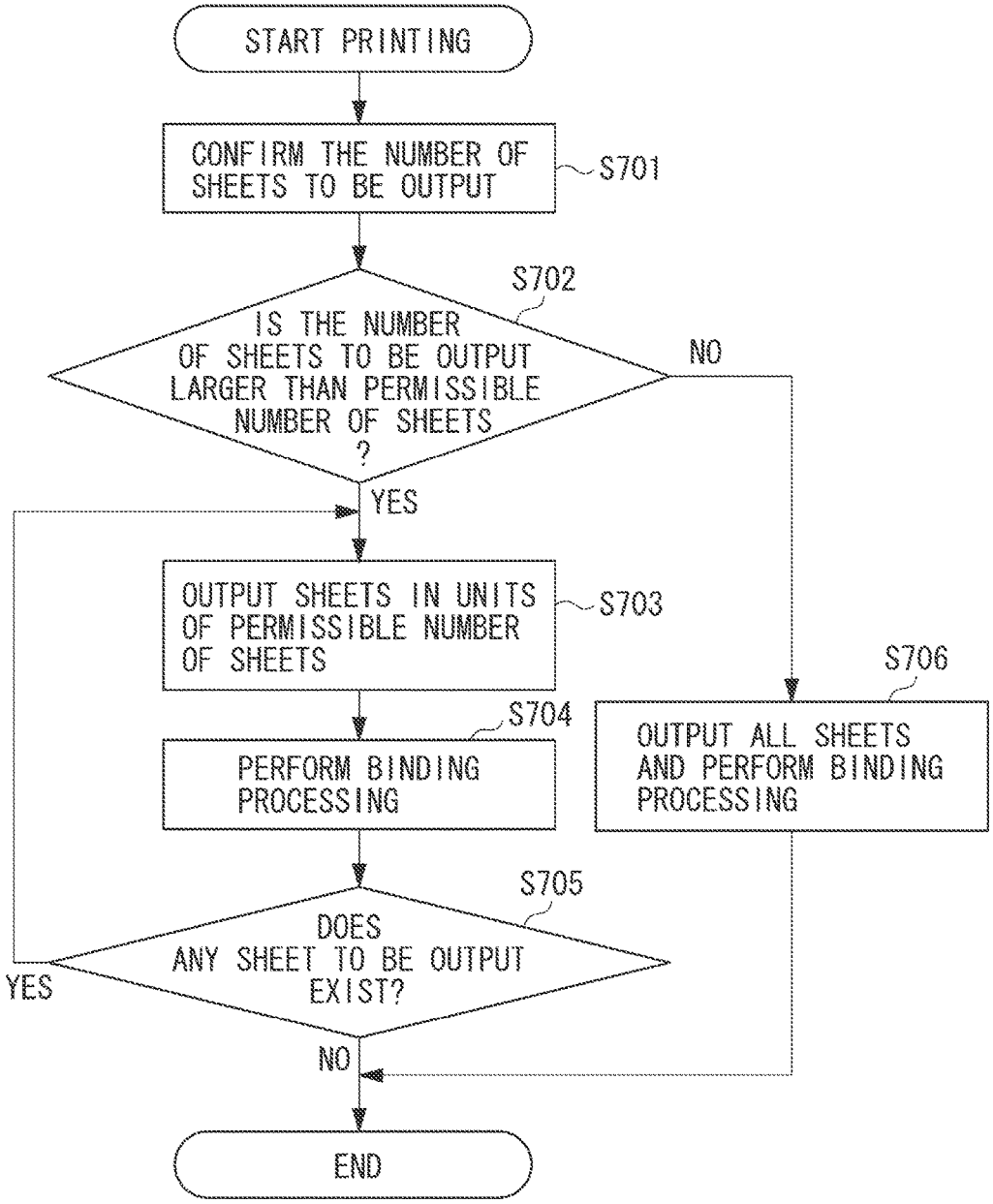
FIG. 7 is a flowchart illustrating a method for controlling a printing control apparatus according to a first exemplary embodiment.

FIG. 7 is a flowchart illustrating a method for controlling the printing control apparatus according to the present exemplary embodiment. In the present exemplary embodiment, the stapleless binding processing is performed. Specifically, when the number of sheets to be output is larger than the maximum number of bindable sheets, the sheets of an output product are divided into a plurality of sheet groups to be applied stapleless binding to the respective sheet groups. Each step is implemented when the CPU 101 illustrated in FIG. 1 executes a program for implementing the flowchart illustrated in FIG. 7 stored in the ROM 102. The stapleless binding processing by the second binding unit 203 will be described in detail below.

After a print job is started, in step S701, the CPU 101 confirms the number of sheets of an output product to be printed for the print job. In step S702, the CPU 101 determines whether the confirmed number of sheets to be output is larger than the maximum number of bindable sheets (hereinafter, referred to as permissible number of sheets) permitted by the second binding unit 203. Although, in the present exemplary embodiment, the permissible number of sheets is statically determined by the second binding unit 203, the permissible number of sheets may be dynamically changed according to the sheet type. The sheet type is determined by the sheet thickness and weight.

When the CPU 101 determines that the number of sheets to be output is larger than the permissible number of sheets (YES in step S702), then in step S703, the CPU 101 instructs the recording unit 107 to output a sheet group corresponding to the permissible number of sheets from the top of the output product. In step S704, the CPU 101 controls the sheet processing unit 109 to apply the stapleless binding processing to the divided sheet groups by using the second binding unit 203.

In step S705, the CPU 101 determines whether any sheet to be output exists in the output product. When the CPU 101 determines that any sheet to be output exists in the output product (YES in step S705), the processing returns to step S703. In step S703, the CPU 101 instructs again the recording unit 107 to output a sheet group corresponding to the permissible number of sheets. In step S704, the CPU 101 instructs the sheet processing unit 109 to apply the second binding processing to the relevant sheet group. When the CPU 101 determines that the remaining number of sheets is less than the permissible number of sheets in step S704, the CPU 101 instructs the sheet processing unit 109 to apply the second binding processing to the remaining number of sheets, and the processing exits this flowchart. In step S703, the CPU 101 may instruct the recording unit 107 to output a sheet group having any number of sheets equal to or less than the permissible number of sheets.

When the CPU 101 determines that the number of sheets to be output is not larger than the permissible number of sheets (NO in step S702), then in step S706, the CPU 101 instructs the recording unit 107 to output all sheets of the output product. Then, the CPU 101 controls the sheet processing unit 109 to apply the stapleless binding processing by using the second binding unit 203 to all sheets, and the processing exits this flowchart.

In the processing illustrated in FIG. 7, the CPU 101 divides the output product into the plurality of sheet groups in units of the permissible number of sheets, and applies the stapleless binding processing to each of the plurality of sheet groups.

By performing the above-described processing, the printing control apparatus can realize binding processing on the output product having the number of sheets equal to or larger than the permissible number of sheets by using the second binding unit 203 without largely degrading the convenience.

In the above-described exemplary embodiment, when the stapleless binding processing is specified and the number of sheets subjected to binding is larger than the number of sheets bindable by the second binding unit 203, the CPU 101 instructs the second binding unit 203 to apply binding processing to each of the plurality of sheet groups. Further, when the stapleless binding processing is specified and the number of sheets subjected to binding is less than the number of sheets bindable by the second binding unit 203, the CPU 101 instructs the second binding unit 203 to apply binding processing to all pages.

When performing binding processing a multiple number of times in units of the permissible number of sheets, it is also possible to move binding positions to apply the stapleless binding processing at different binding positions.

A second exemplary embodiment below will be described below. In the above-described first exemplary embodiment, a case is described in which, when the CPU 101 determines that the number of sheets subjected to binding is larger than the permissible number of sheets set in the second binding unit 203 (YES in step S702), the CPU 101 divides the sheets subjected to binding into a plurality of sheet groups in units of the permissible number of sheets to apply binding processing to each sheet group. On the other hand, in the present exemplary embodiment, a case is described in which, when the CPU 101 determines that the number of sheets subjected to binding is larger than the permissible number of sheets set in the second binding unit 203, the CPU 101 displays a UI screen illustrated in FIG. 9 to determine whether the user wants to divide the output product in a plurality of volumes, to perform binding processing based on the user's selection.

Figure 8:
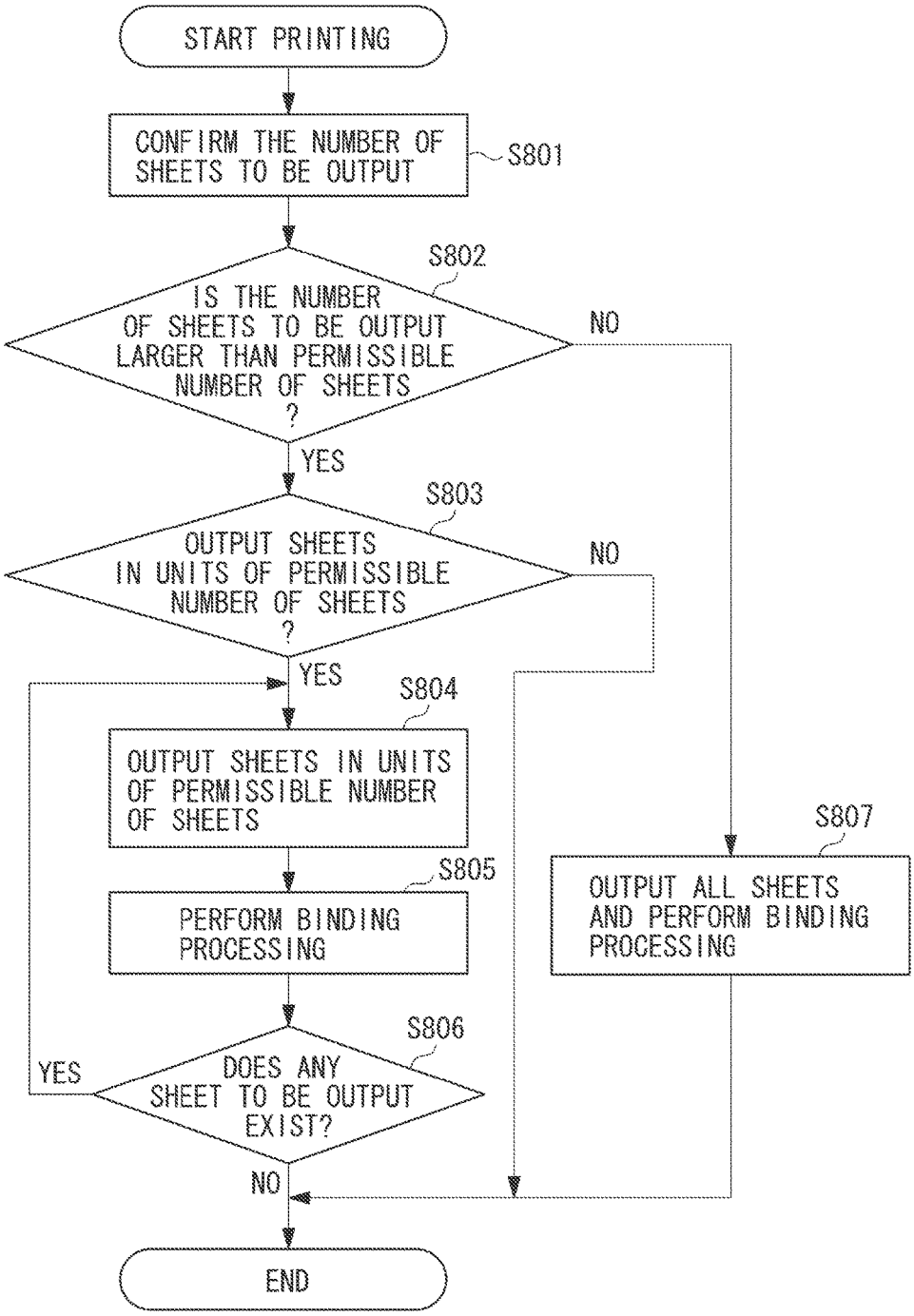
FIG. 8 is a flowchart illustrating a method for controlling a printing control apparatus according to a second exemplary embodiment.

FIG. 8 is a flowchart illustrating a method for controlling the printing control apparatus according to the present exemplary embodiment. In the present exemplary embodiment, when the second binding unit 203 for performing the stapleless binding processing is used, and the number of sheets to be output is larger than the permissible number of sheets, the CPU 101 divides the sheets into a plurality of sheet groups to perform binding processing thereon. Each step is implemented when the CPU 101 illustrated in FIG. 1 executes a program for implementing the flowchart illustrated in FIG. 8 stored in the ROM 102.

Figure 9:
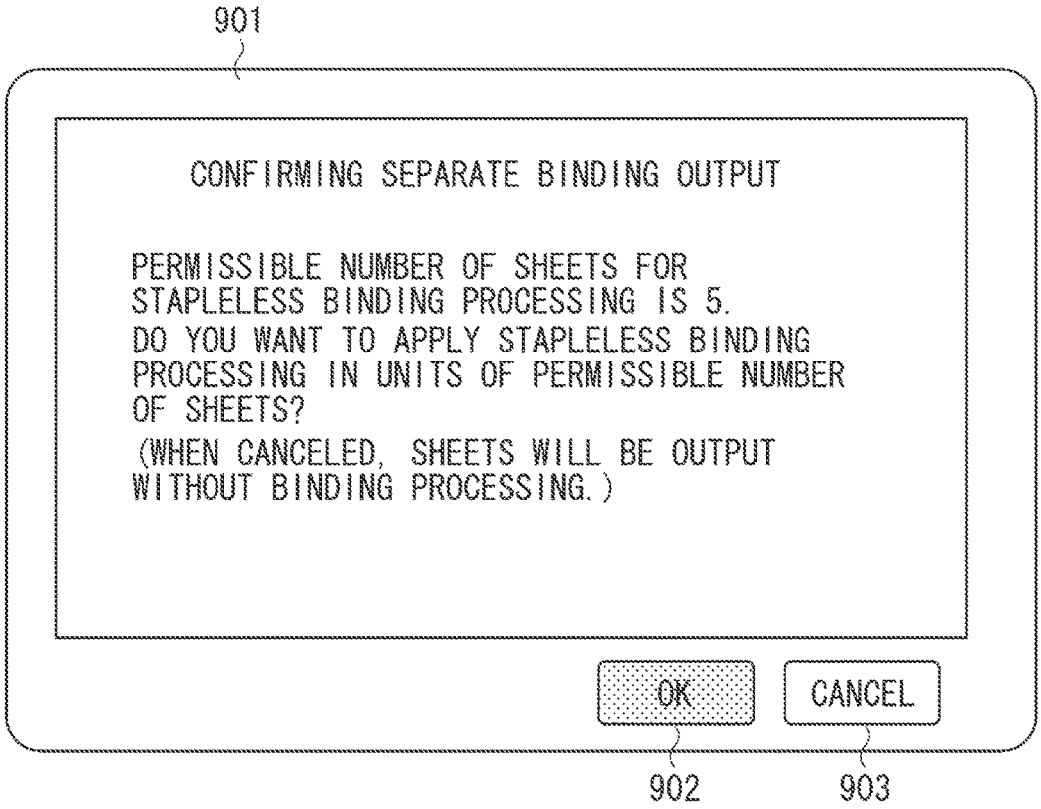
FIG. 9 illustrates an example of a user interface (UI) screen displayed on an operation unit illustrated in FIG. 1.

FIG. 9 illustrates an example of the UI screen displayed on a display of the operation unit 105 illustrated in FIG. 1. The UI screen is displayed on the display of the operation unit 105 under the control of the CPU 101.

After a print job is started, in step S801, the CPU 101 confirms the number of sheets to be output for the print job. In step S802, the CPU 101 determines whether the number of sheets to be output is larger than the permissible number of sheets set in the second binding unit 203. Although, in the present exemplary embodiment, the permissible number of sheets is statically determined by the second binding unit 203, the permissible number of sheets may be dynamically changed according to the sheet type. The output sheet type is determined by the sheet thickness and weight.

When the CPU 101 determines that the number of sheets to be output is larger than the permissible number of sheets (YES in step S802), then in step S803, the CPU 101 displays on the operation unit 105 the UI screen illustrated in FIG. 9 to determine whether the user wants to divide the output product in units of the permissible number of sheets from the top of the output product to output the sheet groups.

The UI screen 901 illustrated in FIG. 9 indicates a case where the permissible number of sheets for the stapleless binding processing is five.

When the CPU 101 determines that the user presses an OK button 902 (YES in step S803), then in step S804, the CPU 101 instructs the recording unit 107 to output a sheet group corresponding to the permissible number of sheets from the top of the output product. In step S805, the CPU 101 controls the sheet processing unit 109 to apply the stapleless binding processing to the relevant divided sheet group by using the second binding unit 203.

In step S806, the CPU 101 determines whether any sheet to be output exists in the output product. When the CPU 101 determines that any sheet to be output exists in the output product (YES in step S806), the processing returns to step S804. When the CPU 101 determines that the remaining number of sheets is less than the permissible number of sheets, in step 805, the CPU 101 instructs the sheet processing unit 109 to apply the second binding processing to the remaining number of sheets.

Otherwise, when the CPU 101 determines that the number of sheets to be output is not larger than the permissible number of sheets set in the second binding unit 203 (NO in step S802), then in step S807, the CPU 101 instructs the recording unit 107 to output all sheets of the output product. Then, the CPU 101 controls the sheet processing unit 109 to apply the second binding processing to all sheets by using the second binding unit 203, and the processing exits this flowchart.

Otherwise, when the CPU 101 determines that the user presses a CANCEL button 903 in the UI screen displayed on the display (NO in step S803), the CPU 101 instructs the recording unit 107 to output all sheets of the output product, and the processing exits this flowchart. In this case, binding processing is not performed.

When outputting an output product having the number of sheets equal to or larger than the permissible number of sheets, the printing control apparatus can provide the user with the binding function using the second binding unit 203 in a simple way by applying the above-described processing.

Figure 10:
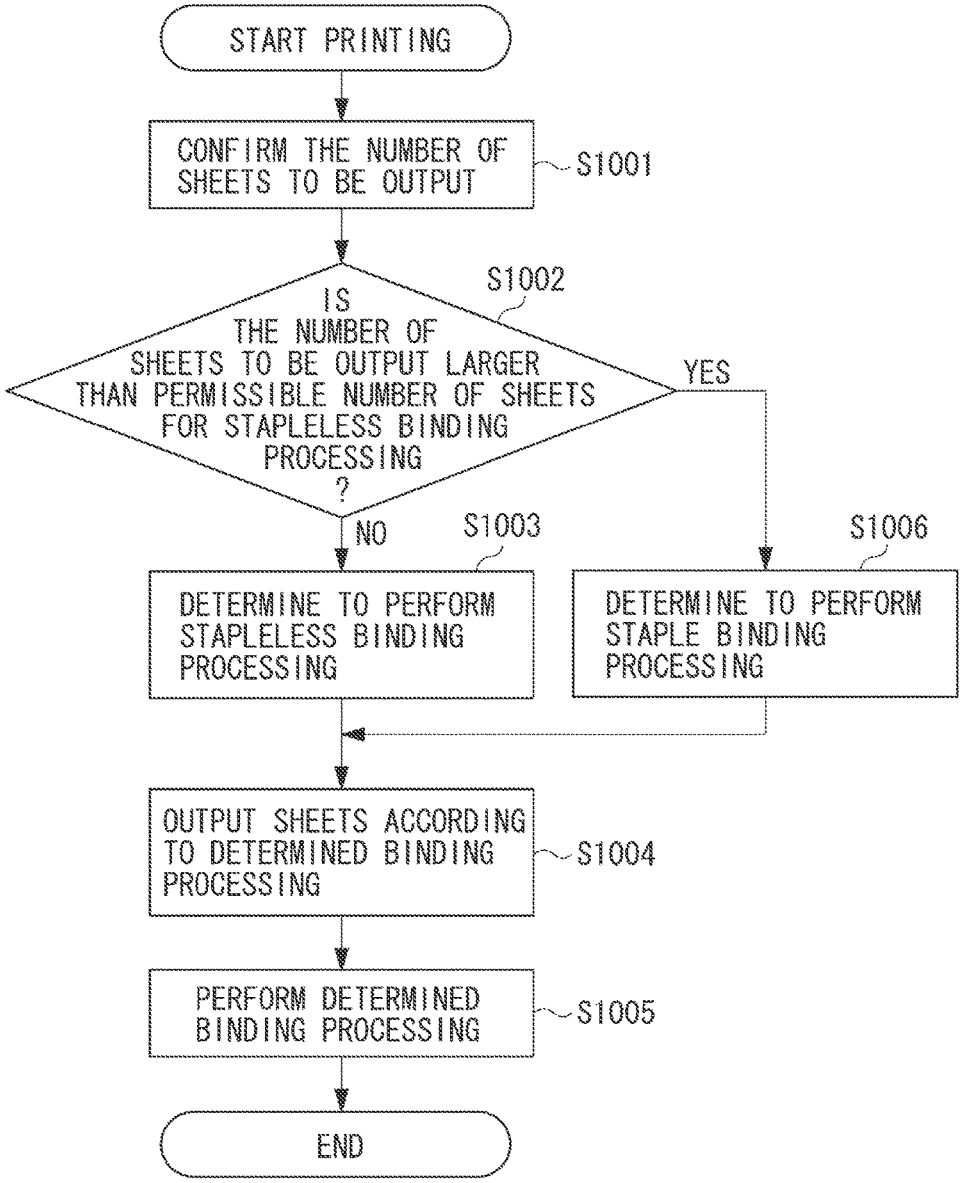
FIG. 10 is a flowchart illustrating a method for controlling a printing control apparatus according to a third exemplary embodiment.

A third exemplary embodiment will be described below. FIG. 10 is a flowchart illustrating a method for controlling the printing control apparatus according to the present exemplary embodiment. In the present exemplary embodiment, the sheet processing apparatus 201 includes both the first binding unit 202 for staple binding and the second binding unit 203 for stapleless binding. Each step is implemented when the CPU 101 illustrated in FIG. 1 executes a program for implementing the flowchart illustrated in FIG. 10 stored in the ROM 102.

After a print job is started, in step S1001, the CPU 101 confirms the number of sheets to be output for the print job. In step S1002, the CPU 101 determines whether the number of sheets to be output is larger than the permissible number of sheets set in the second binding unit 203 for stapleless binding.

When the CPU 101 determines that the number of sheets to be output is not larger than the permissible number of sheets (NO in step S1002), then in step S1003, the CPU 101 determines the second binding unit 203 to be a target binding unit, and the processing proceeds to step S1004.

Otherwise, when the CPU 101 determines that the number of sheets to be output is larger than the permissible number of sheets set in the second binding unit 203 for stapleless binding (YES in step S1002), then in step S1006, the CPU 101 determines the first binding unit 202 to be the target binding unit, and the processing proceeds to step S1004.

Figure 11:
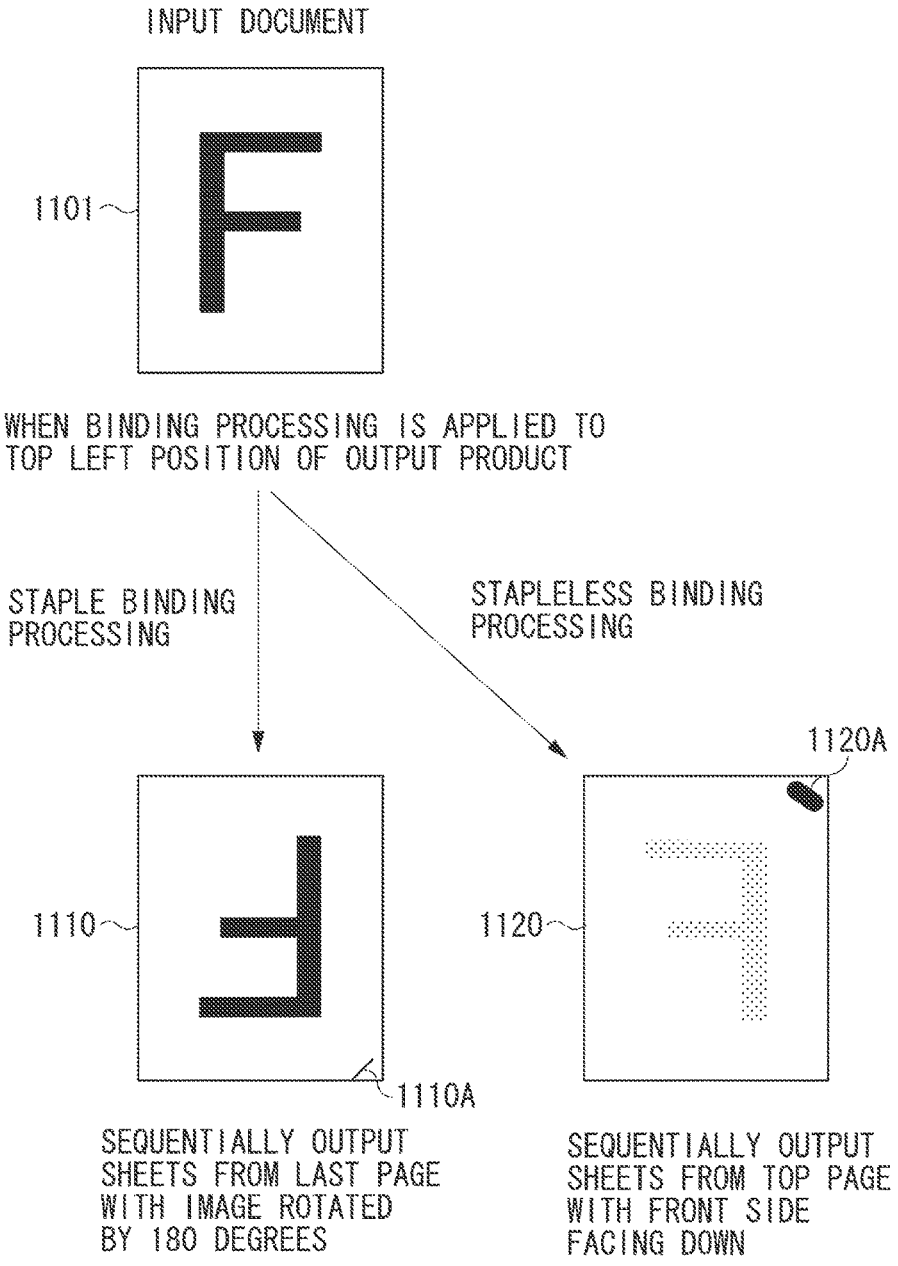
FIG. 11 illustrates binding processing according to different modes of binding processing methods.

In step S1004, as illustrated in FIG. 11, the CPU 101 controls the image processing unit 108 and the recording unit 107 to perform printing according to the determined first binding unit 202 or second binding unit 203. In step S1005, the CPU 101 controls the sheet processing unit 109 to perform binding processing by using the determined first binding unit 202 or second binding unit 203.

More specifically, suppose a case where binding processing is applied at the upper left position of an input document 1101. When the first binding unit 202 is used, the recording unit 107 outputs sheets from the last page with the image data rotated by 180 degrees by the image processing unit 108. In this case, a sheet bundle 1110 is formed with the front side of the top page facing up.

When the second binding unit 203 is used, the recording unit 107 outputs sheets from the top page with the front side facing down. In this case, a sheet bundle 1120 is formed.

In step S1005, the sheet processing unit 109 applies the staple binding processing to the sheet bundle 1110 by using the first binding unit 202 determined in step S1006, and the processing exits this flowchart. Likewise, in step S1005, the sheet processing unit 109 applies the stapleless binding processing to the sheet bundle 1120 by using the second binding unit 203 determined in step S1003, and the processing exits this flowchart.

FIG. 11 illustrates an applied staple 1110A and a stapleless binding portion 1120A.

By performing the above-described processing, the printing control apparatus can realize suitable switching between the staple binding processing and the stapleless binding processing depending on the number of sheets to be output, to apply most suitable binding processing to the output product.

Exemplary embodiments of the present invention are not limited to the above-described exemplary embodiments and may be modified in diverse ways (including organic combinations of the exemplary embodiments) within the spirit and scope thereof, and these modifications are not to be excluded from the scope of the exemplary embodiments of the present invention.

According to the present exemplary embodiment, even when the stapleless binding processing is specified for a sheet bundle having a number of sheets, the sheet bundle can be bound by suitably selecting a binding processing method.

Aspects of the present invention can also be realized by a computer of a system or apparatus (or devices such as a CPU or MPU) that reads out and executes a program recorded on a memory device to perform the functions of the above-described embodiment (s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable storage medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A printing apparatus comprising:

a printing unit configured to print image on a sheet;

a supporting unit configured to support sheets having image printed by the printing unit;

a first binder configured to bind sheets on the supporting unit with a staple;

a second binder, including a first teeth-like member and a second teeth-like member, configured to bind sheets on the supporting unit by biting the sheets between the first teeth-like member and the second teeth-like member with the first teeth-like member and the second teeth-like member, wherein a number of sheets bindable by the second binder is less than a number of sheets bindable by the first binder;

a display unit configured to display a screen; and a control unit configured to control, in a case where a binding processing by the first binder is selected, the first binder to bind a plurality of sheets printed by the printing unit, control, in a case where a binding processing by the second binder is selected and where a number of first sheets subjected to printing by the printing unit is greater than the number of sheets bindable by the second binder, the display unit to display a screen which enables a user to select a predetermined instruction, control, in the case where the predetermined instruction is selected by user via the screen, the second binder such that the second binder binds second sheets included in the first sheets by biting the second sheets on the supporting unit with the first teeth-like member and the second teeth-like member and then the second binder binds third sheets included in the first sheets by biting the third sheets on the supporting unit with the first teeth-like member and the second teeth-like member, and control, in a case where the screen is displayed and where the predetermined instruction is not selected by user via the screen, the second binder not to bind sheets with the first teeth-like member and the second teeth-like member.

2. The printing apparatus according to claim 1, wherein the first binder can be in a first standby-position, wherein the second binder can be in a second standby-position, wherein in a case that a binding processing by the first binder is selected, the first binder moves from the first standby-position to a position where the first binding unit binds the sheets, and wherein in a case that the binding processing by the second binder is selected, the second binder moves from the second standby-position to a position where the second binding unit binds the sheets.

3. The printing apparatus according to claim 1, wherein after the first and second teeth-like members of the second binder bite the second sheets, the third sheets are supported on the supporting unit, in the case where the predetermined instruction is selected by user via the screen.

4. The printing apparatus according to claim 1, wherein the control unit controls the printing unit to print image on the plurality of sheets and controls the second binder not to bite sheets printed in the case where the predetermined instruction is not selected by user via the screen.

5. The printing apparatus according to claim 1, whether the screen enables user to select the predetermined instruction to divide the first sheets subjected to printing by the printing unit into a plurality of sheet groups.

6. A printing apparatus comprising:

a printing unit configured to print image on a sheet;

a supporting unit configured to support sheets printed by the printing unit;

a binding unit configured to bind sheets on the supporting unit, the binding unit including, a first binder configured to bind sheets on the supporting unit with a staple, and a second binder, comprising a first teeth-like member and a second teeth-like member, configured to bind sheets on the supporting unit by biting the sheets between the first teeth-like member and the second teeth-like member with the first teeth-like member and the second teeth-like member, wherein a number of sheets bindable by the second binder is less than a number of sheets bindable by the first binder; and a controller configured to perform one of a first process, a second process, and a third process in a case where a binding process by the binding unit is designated and where a number of first sheets subjected to printing by the printing unit is a first number greater than the number of sheets bindable by the second binder and less than the number of sheets bindable by the first binder, wherein in the first process, the controller controls the second binder to bind second sheets included in the first sheets subjected to printing by the printing unit with the first teeth-like member and the second teeth-like member and then the controller controls the second binder to bind third sheets included in the first sheets subjected to printing by the printing unit with the first teeth-like member and the second teeth-like member, in the second process, the controller controls the first binder to bind the first sheets printed by the printing unit with the staple, and in the third process, the sheets printed by the printing unit are not bound by the first and second binders.

7. The printing apparatus according to claim 6, wherein the first binder can be in a first standby-position, wherein the second binder can be in a second standby-position, wherein in a case that a binding processing by the first binder is selected, the first binder moves from the first standby-position to a position where the first binding unit binds the sheets, and wherein in a case that the binding processing by the second binder is selected, the second binder moves from the second standby-position to a position where the second binding unit binds the sheets.

8. The printing apparatus according to claim 6, wherein in the first process, after the first and second teeth-like member of the second binder bite the second sheets, the third sheets are supported on the supporting unit.

9. The printing apparatus according to claim 6, wherein the control unit controls the printing unit to print image on sheets and controls the second binder not to bite sheets printed in the third process.

10. The printing apparatus according to claim 1, wherein the control unit is configured to control the second binder such that the first teeth-like member and the second teeth-like member bite the second sheets on the supporting unit at least twice and then the first teeth-like member and the second teeth-like member bite the third sheets on the supporting unit at least twice.

* * * * *